United States Patent [19]

Inculet et al.

[11] Patent Number: 4,517,078

[45] Date of Patent: May 14, 1985

[54] METHOD AND APPARATUS FOR SEPARATING PARTICULATE MATERIALS

[75] Inventors: Ion I. Inculet, London, Canada; Anna K. E. Norberg, Mölndal, Sweden; Nicholas M. Hepher, Lamberhurst, England

[73] Assignee: Blue Circle Industries PLC, London, England

[21] Appl. No.: 551,810

[22] Filed: Nov. 15, 1983

[30] Foreign Application Priority Data

Nov. 17, 1982 [GB] United Kingdom ..... 8232855

[51] Int. Cl.[3] ..... B03C 7/04

[52] U.S. Cl. ..... 209/127.3; 209/128

[58] Field of Search ..... 209/1, 127 R, 127 A, 209/127 B, 128-131; 204/164, 180 R, 186

[56] References Cited

U.S. PATENT DOCUMENTS

| | | | |
|---|---|---|---|
| 2,699,869 | 1/1955 | Gear | 209/127 |
| 2,848,108 | 8/1958 | Brastad et al. | 209/127 B |
| 3,162,592 | 12/1964 | Pohl | 209/127 R |
| 3,401,795 | 9/1968 | Tauveron | 209/127 R |
| 3,720,312 | 3/1973 | Shook et al. | 209/127 B |
| 3,739,554 | 6/1973 | Whetten et al. | 209/127 R |
| 3,853,750 | 12/1974 | Volsy | 209/127 R |
| 4,357,234 | 11/1982 | Inculet et al. | 209/128 |

*Primary Examiner*—Howard S. Williams
*Assistant Examiner*—Terryence Chapman
*Attorney, Agent, or Firm*—Brooks, Haidt, Haffner & Delahunty

[57] ABSTRACT

Particles having different properties (e.g. particulate fly ash and carbon) are separated by driving the particles by means of a vibratory feeder (12) forwards along a horizontal electrode plate (1) above which is mounted a second electrode (2) having at least one plate (4) mounted at an acute angle ($\alpha$) to the horizontal. Preferably, two plates (4) each extend sideways from a central block (3) of dielectric material. An alternating electric field is generated between the electrodes (1, 2) by a high voltage AC power source (14). The potential across each plate (4) varies (in particular, decreases) in the lateral direction, the variation being continuous or stepwise. The field lines (16) from each plate (4) curve to the side and impart centrifugal forces to particles charged by friction or conductive induction, which forces separate lighter, more heavily charged particles from the others. The separated particles are collected in bins (13) arranged around the lower electrode (1).

22 Claims, 5 Drawing Figures

METHOD AND APPARATUS FOR SEPARATING PARTICULATE MATERIALS

FIELD OF THE INVENTION

The present invention relates to a method and to an apparatus for separating particles having different properties, in particular to such a method and apparatus whereby electrostatic separation of the particles is effected by means of an alternating electric field.

BACKGROUND TO THE INVENTION

Many techniques are available in industry for the separation of the components of a mixture of particulate solids. For example, where the materials to be separated differ substantially in particle size, separation may be achieved using screens or sieves. In cases where the components of the mixture differ in density, it may be possible to achieve separation using a fluidized bed or by means of froth-flotation. Electrostatic separators are also known, which use high voltage fields to attract or repel particles in order to effect separation of materials whose particles differ substantially in the electric charges acquired through various electrification processes.

British Patent Specification No. 2,099,729A and the corresponding U.S. Pat. No. 4,357,234, (the teaching of which documents is incorporated herein by reference) describe an electrostatic method and an apparatus that can be used to separate particles that have different physical properties, for example conductivity, mass, size or density.

The said method comprises the steps of charging the particles; and driving the particles in a forward direction through an alternating electric field—in particular a field of non-uniform intensity in a direction perpendicular to the forward direction—having field lines curved in the perpendicular direction whereby the particles are subjected to a centrifugal force in the perpendicular direction, the centrifugal force on each particle being dependent on the mass, size and electric charge of the particle whereby different particles are separated along the perpendicular direction.

The said apparatus comprises means for generating an alternating electric field having a predetermined length and width, wherein the field lines are curved in the direction of the width of the field; means for inserting the particles into one end of the electric field at the side away from the curvature of the field lines; and means for driving the particles through the electric field along the length of the electric field.

In a preferred form, that apparatus comprises a first electrode in the form of a metallic plate mounted on a conventional vibratory feeder.

A second electrode, also in the form of a metallic plate, is mounted above the first electrode at an acute angle (typically 12°) thereto in a lateral direction. In operation, the electrodes are connected to a high voltage AC source which produces an alternating electric field between the electrodes. The field lines are curved, owing to the inclination of the second electrode with respect to the first.

A chute is arranged to deliver a mixture of particulate materials on to the upper surface of the first electrode at one end thereof and adjacent the side where there is the least separation between the first and second electrodes.

The vibratory feeder is so arranged as to transport particles along the length of the first electrode.

The particles moving along the length of the first electrode will acquire charges owing to triboelectrification and/or conductive induction. The curved field lines impart a circular motion to the charged particles which has the effect of subjecting those particles to a centrifugal force. Thus the particles will tend to move in a lateral direction, specifically in the direction in which the two electrodes diverge.

The higher the charge on a particle (compared with otherwise similar particles), or, for equal charges, the smaller or less dense the particle is, the greater will be the motion in the said lateral direction. For example, if pulverised fly ash (PFA) contaminated with carbon is fed to the apparatus, the heavier, less charged fly-ash particles will deviate little from the path determined by the vibratory feeder, whereas the lighter, more heavily charged carbon particles will tend also to be moved in a lateral direction under the influence of the alternating field. Bins or other receptacles are placed at appropriate points with respect to the first electrode for the collection of PFA-rich fractions and carbon-rich fractions.

Although the above-described apparatus represented a significant advance in the art, it has since been found that its operation can be improved in a number of respects.

It has been found that the width of the lower conveyor electrode is limited by the range of action of the oscillating electric field generated by the upper electrode. The intensity of the electric field is determined by the voltage applied to the upper electrode and, for any given region of the field, by the local distance between the upper and the lower electrodes. Owing to the angle between the two electrodes, the distance between the upper and lower electrode increases in the width-wise direction. As the electrodes diverge, there is a corresponding decrease in the electric field intensity. An attempt to increase the field intensity by increasing the potential applied to the upper electrode would significantly increase the likelihood of electrical breakdown (sparkover), in particular in the region of minimum distance between the upper and lower electrodes.

SUMMARY OF THE PRESENT INVENTION

The present invention now provides a method of separating particles having different physical properties, which comprises generating an alternating electric field, the electric field having a first region having field lines curved in a first direction generally perpendicular to a given direction; introducing the particles into the field; charging at least some of the particles; and causing the particles to move along the field in said given direction, whereby a charged particle acted upon by the electric field in the said first region is subjected to a force in the said first direction, characterised in that the potential across the said first region of the field varies with distance along the said first direction. The force on the particle tends to separate that particle along that perpendicular direction from particles having different properties.

In preferred embodiments, the electric field has a second region having field lines curved in a second direction generally perpendicular to the said given direction, wherein the potential across the said second region of the field varies with distance along said second direction. In general, the said first and second directions are generally opposite to each other, transversely of the said given direction. Preferably, the said first and second directions are disposed at an angle of from $\pi \pm 0.05$ to $\pi \pm 0.56$ radians, typically $\pi \pm 0.17$ radians, to each other.

It is preferred that the potential across the or each of the said regions of the electric field should decrease with distance along the respective perpendicular direction. In such a case, it has been found that the curvature of the electric field lines is enhanced to such an extent that it may more than compensate for the decrease in the field intensity.

The invention also provides an apparatus for separating particles having different properties, which comprises means for generating an alternating electric field, the electric field having a first region having field lines curved in a first direction generally perpendicular to a given direction; means for introducing the particles into the field; and means for causing the particles to move along the field in the said given direction; characterised in that the means for generating the electric field is such that the potential across the said first region of the field varies with distance along the said first direction. Usually, the electric field-generating means and the particle-moving means will be sufficient to ensure that at least some of the particles are charged by conductive induction and/or triboelectrification; however, the provision of additional particle-charging means is not excluded herein.

Preferably, the apparatus is such that the field-generating means comprises a first electrode means providing a first surface; the particle-introducing means is arranged to deliver the particles unto the said first surface of the first electrode means; the particle-moving means is adapted to move the particles along the said first surface in a given direction; and the field-generating means also comprises a second electrode means, providing a second surface and a third surface, and power source means adapted to apply an alternating potential difference between the first and the second electrode means and produce an alternating electric field extending between the said first surface and the said second and third surfaces. The second surface diverges from the first surface to one side of the apparatus, whereas the third surface diverges from the first surface to the other side of the apparatus. The arrangement is such that the potential across each of the second and third surfaces varies with distance along a direction perpendicular to the given direction.

BRIEF DESCRIPTION OF THE DRAWINGS

In the Figures, like parts are indicated by like numerals.

DESCRIPTION OF THE PREFERRED EMBODIMENTS

Figure 1:
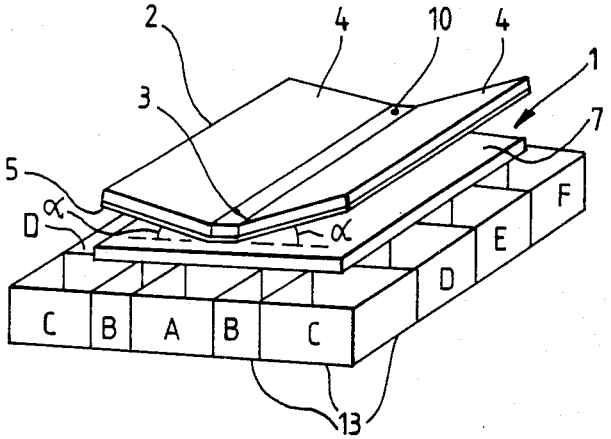
FIG. 1 is a diagram showing, in perspective, the arrangement of the electrodes in an apparatus of the present invention and showing the disposition of receptacles for collecting fractions of materials separated by means of the apparatus.
Figure 2:
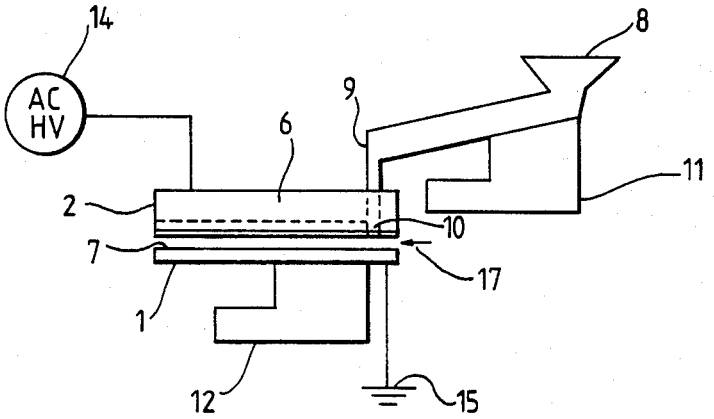
FIG. 2 is a diagram indicating the components of an apparatus according to the invention, as seen in a side view.

The exemplary embodiment shown in FIGS. 1–2 comprises a first electrode means 1 in the form of a conductive plate of generally rectangular plan which plate is mounted substantially horizontally. A second electrode means 2 is mounted above the first electrode means 1 and is spaced from it.

The second electrode means 2 comprises a central member 3 in the form of an elongate block having a substantially rectangular cross-section, the central member extending parallel to the first electrode means in the lengthwise direction. Extending from each of the two long sides of the central member 3 is a wing 4. The lowermost surface of the electrode means 2 (i.e. the surface facing the first electrode means) may be provided with a layer 5 of dielectric material.

Each wing 4 is substantially rectangular in plan and has a substantially planar lower surface 6 which subtends an angle $\alpha$ (preferably up to 0.56 radian, especially from 0.1 to 0.28 radian) to the planar upper surface 7 of the first electrode means 1. Thus, the second electrode means has an "inverted roof" structure with the central member 3 at its apex, the two surfaces 6 being disposed at an angle of $\pi+2\alpha$ radians to each other. (Disposing the surfaces 6 at an angle to each other of $\pi-2\alpha$ radians would place the central member 3 uppermost, instead of as illustrated.)

A mixture of particulate materials to be separated may be delivered from a hopper or funnel 8 which communicates via conduit 9 with a bore 10 extending vertically through the central block 3 at one end of the latter. To ensure a proper flow of the material through the conduit 9, a vibratory feeder 11, for example a Syntron (trade mark) feeder, is provided. Of course, an alternative feed device could be used, for example a screw conveyor or an auger feeder.

Material passing through the bore 10 in the central block 3 will fall onto the upper surface 7 of the first electrode means at one end thereof. The first electrode means is mounted on a vibratory transducer 12 (see FIG. 2), e.g. a Syntron device, which is adapted, in operation, to drive the material falling onto the surface 7 from bore 10 in a direction towards the other end of the surface 7 (the "forward direction"). Of course, other means could be employed to move the particulate material along the plate in the forward direction. Bins 13, or other suitable receptacles, are provided and are so placed as to collect particulate material falling over the front edge and side edges of the plate constituting the first electrode means 1.

In operation, a potential difference is applied between the first electrode means and the second electrode means. In the illustrated embodiment, a high-voltage, alternating-current power source 14 is connected to each wing 4 of the second electrode means 2 (see FIGS. 2, 3 and 4), whereas the first electrode means 1 is grounded (earthed) as indicated at 15. The potential difference will generate an electric field between the first and the second electrode means. In the region of the electric field between the first electrode means 1 and each wing 4, the field lines 16 will be curved (see FIGS. 3 and 4) owing to the inclination of the wing 4 relative to the first electrode means. As shown, the field lines 16 from either wing 4 curve in a direction perpendicular to the forward direction, i.e. the convex sides of the lines face in the direction in which wing 4 diverges from plate 1.

The permittivity of the material of the central member 3 being greater than that of air, the electric field lines emerging from the innermost edges of the wings 4 will, in general, first penetrate the central member 3 and then descend substantially vertically towards the first electrode means 1. Thus, the field lines under the central member 3 will generally be rectilinear. Nevertheless, it has been found in practice that the particles, during their passage along the first electrode means 1, tend to spread out and sufficient will enter a region of curved electric field lines for effective separation to occur. Thus, the central member 3 helps to effect a gradual introduction of particulate material into the two "centrifugally active" regions of the electric field.

An appropriate frequency for the power source may be readily determined for any given case. The frequency will generally be up to 100 Hz, and is typically within the range from 5 to 60 Hz. It has been found that the larger the dimensions of the apparatus, the more suitable are the lower frequencies.

The first electrode means may be fabricated from any appropriate material, provided that the first electrode surface 7 is conductive. Metals such as bronze, copper, aluminium and steel may be employed. It is particularly important that the upper surface 7 of the first electrode means should remain conductive during operation; thus, a material such as stainless steel is preferred to a material such as aluminium, which may be susceptible to oxidation.

The purpose of the dielectric layer 5 (not shown in FIGS. 3 and 4) on the underside of the second electrode means 2 is to reduce the likelihood of electrical breakdown between the first and second electrode means. The relative permittivity (compared to air) of the layer material will generally be 3 or more, typically from 3 to 7. Although, in principle, most insulating materials could be employed (including glass, mica or porcelain), it is preferred for ease of fabrication that the layer material should have good moulding properties. Materials which have proved suitable include natural and synthetic elastomers as well as synthetic resins (plastics), for example silicone rubber, polyamides (e.g. Nylon), epoxy resins, polyesters and fibreglass/polyester composites.

The central member 3 can be fabricated from any of the dielectric materials suitable for the layer 5.

As indicated above, the vibratory transducer 12 serves to drive the particulate material falling onto the plate 1 from the bore 10 in a forward direction. However, in order to inhibit the particles from sticking to one another and to the surface 7 of the lower electrode, the stream of moving particles may be subjected to pulsed jets of gas. In the illustrated embodiment, a slot-shaped nozzle is positioned at the point indicated by 17 (FIG. 2) to direct a pulsed air stream along the upper surface 7 of the first electrode means 1 in the forward direction below the central member 3. Furthermore, the central member 3 may be drilled with a series of small holes (not shown) which may be connected to a pulsed air supply in order to direct intermittent jets of air towards the upper surface 7 of the first electrode means.

Other means, for example rappers (not shown) may be provided to remove material that adheres to the electrode surfaces during operation, should the accumulation of such material prove to be a problem.

The operation of the apparatus may be described, by way of an example, with reference to the beneficiation of pulverized fly ash (PFA) contaminated with carbon particles. The contaminated PFA is dumped in the funnel or hopper 8, the power source 14 is connected to the electrode means and the plate constituting the lower electrode 1 is set into vibratory motion by switching on the vibratory transducer 12. The feeder 11 is then switched on in order to convey a stream of the contaminated PFA through a conduit 9 and a bore 10 onto the upper surface 7 of the first electrode means 1. The stream of particulate material is then moved in the forward direction by the transducer 12. Particle individualisation is increased and sticking of the particles is decreased by means of pulsed air currents supplied through the nozzle at 17 and through the series of holes drilled in the central member 3 of the upper electrode means 2.

The carbon particles tend to become much more highly charged than the particles of fly ash, whether the charging be due to triboelectrification, conductive induction, ion or electron bombardment or a combination thereof. Accordingly, the carbon particles are subjected to a greater electrostatic force by the electric field. The oscillatory motion of the carbon particles under the electrostatic force will tend to follow the field lines, which, being curved in a direction perpendicular to the forward direction, will result in a centrifugal force on the carbon particles in that perpendicular direction. Thus, whereas the main mass of fly ash will tend to remain below the central member 3 as it moves along the surface 7, the carbon particles will be urged by the said centrifugal force (or the transverse component thereof) in a lateral direction. As a result, the bins A, B and C (see FIG. 1) will receive ash-rich fractions, whereas the bins D, E and F will receive carbon-rich fractions.

It is possible, of course, to subject the collected fractions to one or more further separating operations using the apparatus of the invention. By means of such a multi-stage separation procedure, it is possible to obtain the desired component or components with a higher degree of purity.

The invention is not limited to the separation of carbon from PFA. In general, it is applicable to the separation of components of a mixture of particulate materials that so differ in properties that one component will be subjected to a significantly higher centrifugal force in the curved electric field. Accordingly, the invention can be used to separate a conductive component from an insulating component, or to separate components that differ significantly in particle mass, size or density.

A method and an apparatus for separating particles employing an upper electrode in the form of an inverted roof, as described above, are the subject of the copending patent application Ser. No. 551,916 claiming priority from British Patent Application No. 8232853, the teaching of which copending application is incorporated herein by reference. However, as implied above, the method and apparatus disclosed in British Patent Specification No. 2,099,729A and U.S. Pat. No. 4,357,234 can also be modified in accordance with the present invention.

With reference to the apparatus depicted in FIGS. 1 and 2, it will be understood that the construction of the electrode means 2 and the connection thereof with the voltage source 14 must, in accordance with this invention, be such that the potential varies across each electrode wing in the lateral direction. Possible arrangements are described below with reference to FIGS. 3, 4 and 5. However, it is to be understood that various elements (such as the dielectric layer 5, the material supply means 8, 9, 10, 11, the vibratory transducer 12 and the collecting bins 13) have been omitted from FIGS. 3, 4 and 5 for the sake of clarity.

Figure 3:
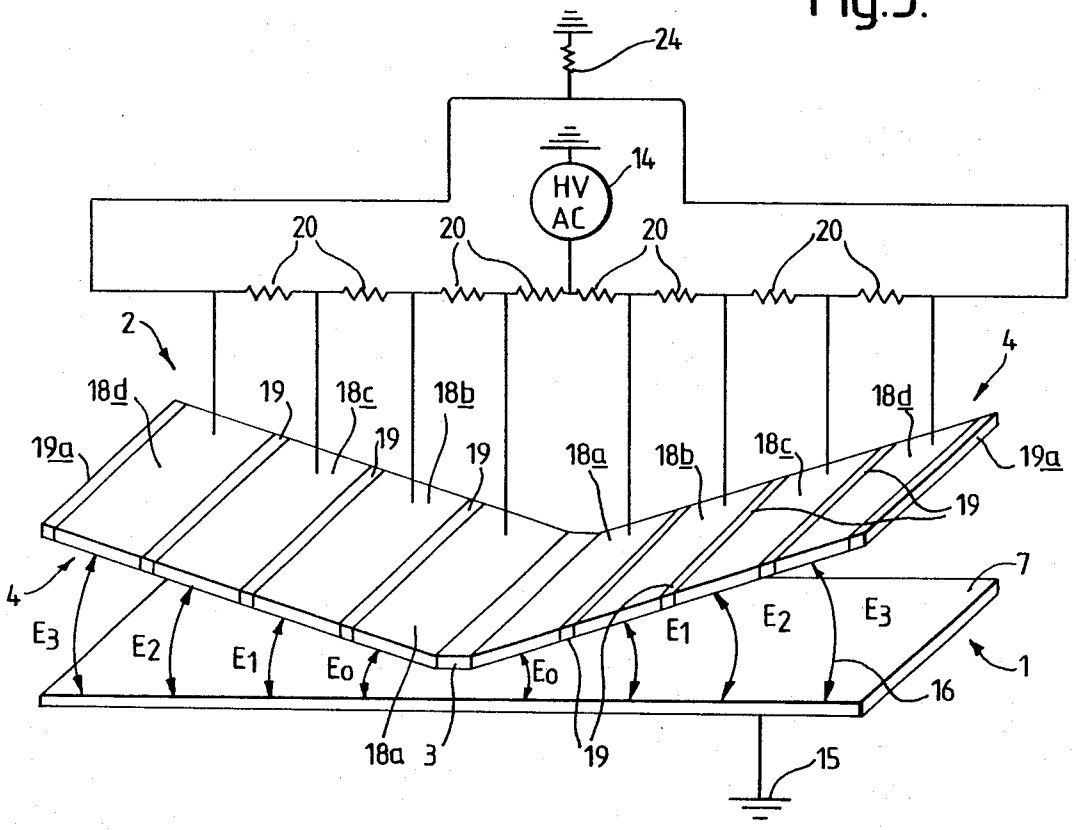
FIG. 3 is a diagrammatic representation, shown in perspective, of the electrode system of an embodiment of the present invention.

In the embodiment shown in FIG. 3, each wing 4 of the upper electrode means 2 comprises a line of conductive plates 18, each plate 18 being separated from the next succeeding plate by a separating element 19 made from a dielectric material. The separating elements 19 can be made from any of the dielectric materials mentioned above as being suitable for the layer 5 and the central element 3. Each plate 18 and each separating element 19 extends along substantially the entire length of the respective wing 4. It has been found advantageous to provide an element 19*a* of dielectric material at the outermost edge of each wing since this will reduce the possibility of undesirable field effects at the sides of the apparatus. The plates 18 may be of metal, e.g. copper, aluminium or stainless steel.

The earthed terminal of the high-voltage alternating power supply 14 is, in fact, connected through a resistor 24, also earthed, to each of the outermost plates 18*d* in the second electrode means 2, and the high voltage terminal is connected through one or more resistors 20 (arranged in series) to the other plates 18*c*, 18*b* and 18*a*. Thus, the voltage applied to the innermost plates 18*a* will be higher than the voltage applied to the adjacent plate 18*b*. The voltage applied at the third plate 18*c* will be between the voltages applied at plates 18*b* and 18*d*.

The value of the individual resistors 20 can be readily selected for the most effective operation in any given case; it is not essential, in principle, that the values of the resistors 20 should be identical.

An arrangement such as that shown in FIG. 3 generates electric field lines with a pronounced curvature and resulting strong centrifugal force. Thus, the decrease in field intensity due to the divergence of the electrodes can be compensated by the increased curvature of the field lines that generate the centrifugal motion. The arrangement also permits a degree of control over the intensity of the electric field in the direction perpendicular to the forward direction.

By way of example, the field intensity at the centre of each of plates 18*a*, 18*b*, 18*c* and 18*d* is represented by $E_0$, $E_1$, $E_2$ and $E_3$, respectively. Thus, by appropriate selection of the values of the resistors 20, these intensities can be predetermined. In general, the intensities will be such that $E_0 \geqq E_1 \geqq E_2 \geqq E_3$ (the field intensity being measured, for example, in $Vm^{-1}$). Of course, each wing 4 of the upper electrode means 2 may contain any desired number of plates 18. Furthermore, the width of each plate 18 and of each separating element 19 can be selected for the most effective operation in any given case.

By maintaining an electric field intensity which decreases gradually in the outward direction, and generates field lines with pronounced curvature, it is possible to employ a larger apparatus than would otherwise be feasible, with a corresponding increase in throughput.

Because of the nature of the operation of the separating apparatus, the actual power demand is comparatively low, even though the high voltage AC power supply may require voltages as high as 15 to 30 kV as measured at the inner plates 18*a* of the electrode wings 4. Mainly reactive power is concerned here, which is produced by the capacitance between the two electrode means 1 and 2.

The embodiment illustrated in FIG. 3 may be modified by dispensing with the plurality of resistors 20, 24 and, instead, providing each of the plates 18*a*, 18*b*, 18*c* and 18*d* with its own voltage source. Such voltage sources may be provided, for example by means of transformer tappings. This modification permits to voltages to be varied more readily and may also be preferable to the embodiment of FIG. 3, in terms of energy savings.

Figure 4:
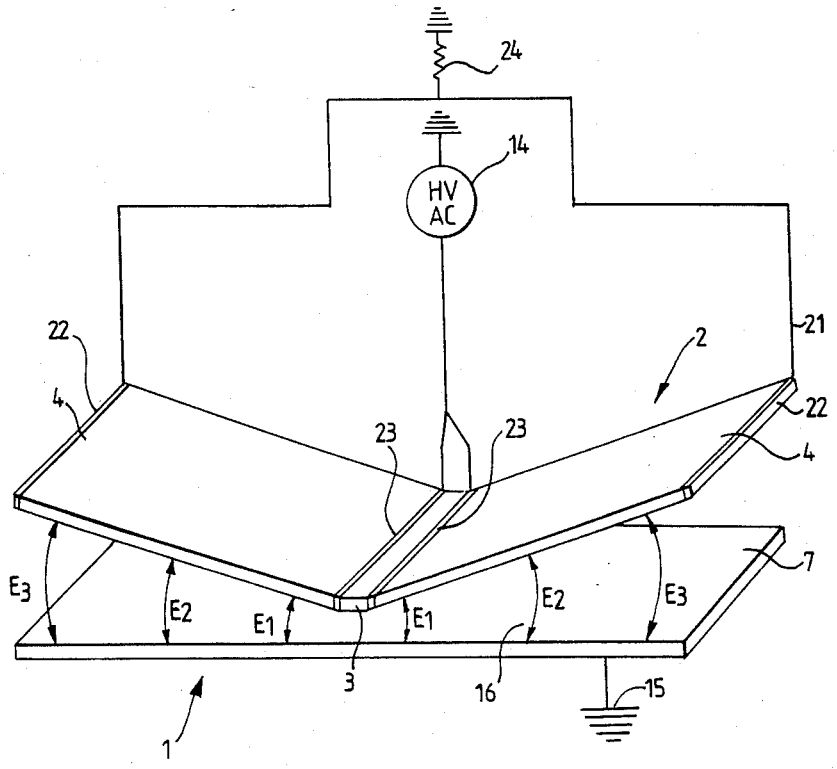
FIG. 4 is a diagrammatic representation, shown in perspective, of the electrode system of a further embodiment of the present invention.

Turning now to the embodiment illustrated in FIG. 4, each electrode wing is fabricated from a conductive material of substantial resistivity. The earthed terminal of the high voltage power source 14 is connected via earth, resistor 24 and line 21 to a conductive strip 22, suitably of metal, at or adjacent the outer edge of each wing 4, which conductive strip 22 forms an electrical connection with the material of the wing 4.

Another conductive strip 23, suitably of metal, is provided at or adjacent the inner edge of each electrode wing 4 (i.e. the edge which abuts the central element 3). The inner conductive strip 22 forms an electrical connection to the material of the wing electrode 4 and is connected to the high-voltage terminal of the power supply 14.

It will be seen that on connecting the power supply 14, a potential gradient will be set up in each electrode wing from the inner-edge strip 23 to the outer-edge strip 22. Thus, the potential of the electrode wing 4 will decrease in the lateral outward direction. The change in potential in this embodiment is continuous, in contrast to the embodiment of FIG. 3 in which the decrease in potential along the electrode wing 4 is discontinuous (i.e. stepwise or incremental). Sample field lines are indicated in FIG. 4 as $E_1$, $E_2$ and $E_3$, the preferred relationship being $E_1 \geqq E_2 \geqq E_3$.

The potential applied at the inner-edge strip 23, the value of the resistor 24 and the resistivity of the material from which the electrode wing 4 is fabricated can be selected for optimum operation for any given case. Trials have been effective in which the voltage at the inner strip 23 is 15–30 kV and the voltage at the outer strip 22 is 0 to 20 kV.

Figure 5:
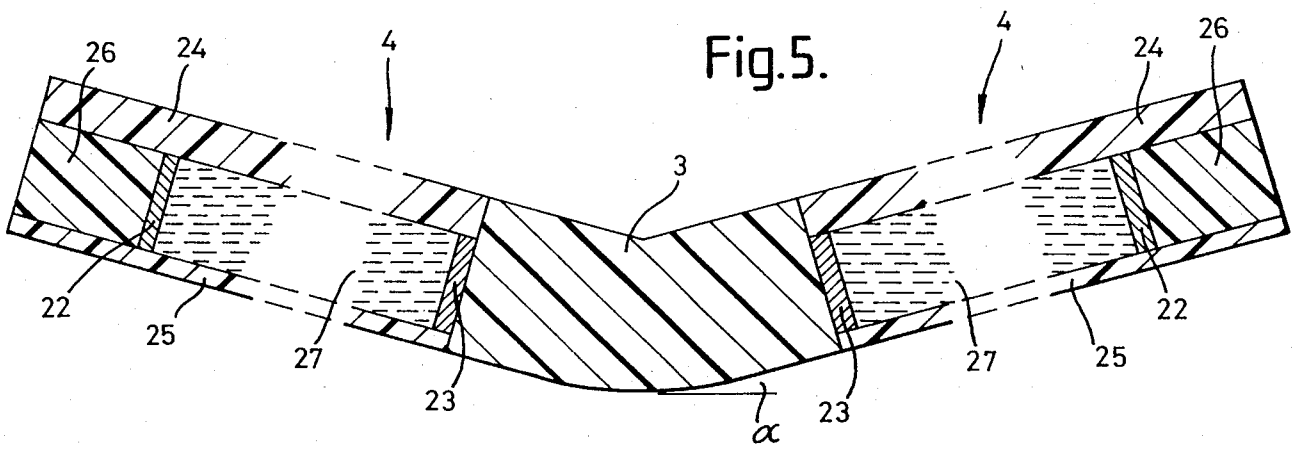
FIG. 5 is a vertical cross-section of the upper electrode means of yet another embodiment of the present invention.

The electrode wings 4 may be fabricated, for example, from a conductive rubber or synthetic resin of appropriate resistivity, although it is preferred at present to construct the electrode wing as a box made from a suitable dielectric material, the box being filled with a conductive liquid of appropriate resistivity, as illustrated in FIG. 5.

The upper electrode of FIG. 5 comprises a central member 3 having a substantially chevron-shaped cross-section, the lowermost part of which is curved. Extending from either side of the central member 3 is a wing 4 in the form of a box constructed from an upper sheet 24, a lower sheet 25 and an elongate block 26 of rectangular cross-section. The box is completed by front and rear panels (not shown) to define a chamber 27, which is filled with a suitable liquid by means of a filling tube (not shown) provided in the top sheet 24 and communicating with said chamber 27. The box and the central member 3 may be constructed of an acrylic resin such as Perspex (trade mark). Along the innermost side wall of the chamber 27 there is provided a metal strip 23, whilst among the outermost side wall of the chamber 27 there is provided a further metal strip 22. Each metal strip 22, 23 is provided with connector means (not shown)

whereby it may be connected to an alternating voltage source.

Suitable resistivity values for the conductive material of the electrode wings 4 are from 1 to 10 Mohm.m. A suitable liquid is transformer oil, e.g. Shell's Diala Oil B, doped with one or more metal salts to give a degree of conductivity. The Shell Additive ASA 350 or ASA 3 (xylene solution) has proved suitable as a dopant ("Shell" is a trade mark). As an example, the resistance of the wing 4 (FIG. 5) filled with doped oil may typically be 86 Mohms. Thus, a potential difference of 86 kV will give rise to a current through the oil of 1 mA. In this embodiment, the use of a layer 5 of dielectric material may not be required, since its function can be fulfilled by the bottoms 25 of the boxes of dielectric material that contain the conductive liquid.

The embodiment of FIGS. 4 and 5 may be modified by dispensing with the line 21 and resistor 24 and, instead, providing the inner strips 23 and the outer strips 22 with respective voltage sources. Thus, the inner strips 23 may be connected to a common voltage source having a higher potential than a common voltage source to which the outer strips 22 are connected. Such an arrangement may, in fact, be preferable to the embodiment shown in FIG. 4, in that it permits the voltages to be varied more readily and may offer savings in energy consumption.

Interestingly, in one experiment some separation was achieved using a potential that decreased in the outward direction, even though the wings of the upper electrode were parallel to the lower electrode. As a modification of the illustrated embodiments, it would be possible to connect the high-voltage AC power supply to the upper electrode means so that the potential is highest at the outermost parts (i.e. plates 18*d* in FIG. 3 or the conductive strips 22 in FIGS. 4 and 5). However, it has been found that such an arrangement tends to diminish the curvature of the field lines and is not, therefore, preferred.

It will be apparent that the illustrated embodiments can be modified in numerous other respects. For example, and with reference to FIG. 1, instead of having just a lower layer 5 of dielectric material, it would be possible to have the electrode plates 4 entirely embedded in, or encapsulated by, an envelope of dielectric material. This may reduce even further the possibility of electrical breakdown. It will be appreciated that any measure that reduces the risk of electrical breakdown will permit the use of higher voltages and/or of shorter distances between the electrodes.

Although, in principle, the plates 4 could be joined at their inner edges, the provision of an intermediate member such as the central element 3 is greatly preferred. The central element 3, being of dielectric material, reduces the likelihood of electrical breakdown in the region where there is minimum separation between the first and the second electrode means. Furthermore, the size and shape of the cross-section of the central element 3 may be selected in order to obtain a desired configuration of field lines below the apex of the second electrode means.

In the illustrated embodiments the vertical projection of the second or upper electrode means and that of the first or lower electrode means are substantially identical. However, this is not essential and either electrode means could extend beyond the other in a given direction. For example, it may be convenient to deliver the particulate mixture, by means of a chute or the like, directly to the upper surface of a part of the first electrode means that extends rearwardly of the upper electrode means. In such a case, it may be found desirable to provide the upper electrode wings with a rearwardly extending metal plate in order to modify the pattern of field lines to ensure that the entry of the particulate mixture into the electric field is not hindered. The metal plate should be isolated.

Although the plates 4 in the illustrated embodiments are planar, it would be possible for each plate to have a cross-section which followed a curve, provided that the plate still diverged from the upper surface of the lower electrode in order to maintain the curvature of the electric field.

Furthermore, it is not essential to have the upper surface of the lower electrode disposed horizontally. For example, it would be possible to have the upper surface tilting up or down at either side of the longitudinal central line of the first electrode means 1 (i.e. a line immediately below the central element 3). Thus, a shallow V-shape could assist in the retention of the heavier particles on the central portion of the lower electrode during their passage along it. It is also possible to arrange the lower electrode means so that the upper surface thereof slopes downwards in the forward direction; such an arrangement permits the transport of the particles to be assisted by gravity. The angle of slope is in general up to 45°, preferably about 18°, with respect to the horizontal.

As illustrated, the electric field has a substantially constant cross section in the forward direction and, indeed, this is at present preferred. However, the electrodes could be so arranged as to increase or decrease that cross-section in the forward direction and thereby decrease or increase the field intensity in that direction. Similarly, there may be cases where it is appropriate to have the plates 4 disposed at different angles to the upper surface 7 of the lower electrode.

It is possible to dispense with the receptacles D, E and F by providing a wall or other barrier at each side edge of the first electrode means 1. The barrier will serve to restrain the more highly charged particles from further lateral movement, although such particles will still be driven in the forward direction. Thus, when using such a modified apparatus for the beneficiation of carbon-contaminated PFA, the carbon particles will tend to accumulate at each of the barriers, the resultant carbon-rich fraction being discharged into the receptacles C (FIG. 1).

In preferred embodiments, the upper surface of the first electrode means 1 is provided by a gas-permeable plate formed, for example, of a sintered metal such as bronze. The gas-permeable plate may constitute the top of a plenum chamber into which a gas, conveniently air, is passed under pressure. The gas will pass through the gas-permeable plate and will fluidise the particles being driven along the upper surface thereof.

As mentioned above, means other than a vibratory transducer may be employed in order to move the particles along the first electrode means in the required direction. The use of a gas-permeable plate as described above permits the particles to be moved along the plate by the simple expedient of having the plate slope downward in the forward direction, as mentioned above. The gas passing through the gas-permeable plate will diminish the frictional resistance of the upper electrode surface 7 to the movement of particles across it, thereby permitting the particles to move forward under the force of gravity. An electrostatic separator that is provided with such a gas-permeable plate is described in greater detail in the co-pending patent application Ser. No. 551,689 claiming priority from British Patent Application No. 8232857; the teaching of the aforesaid co-pending application is incorporated herein by reference.

The present invention is illustrated in and by the following Examples.

EXAMPLE

An apparatus was constructed substantially as shown in FIGS. 1, 2 and 5. The lower electrode plate 1 was approximately 87 cm long and 30 cm wide and was disposed horizontally. Each electrode wing 4 was constituted by a box 87 cm long, 17 cm wide and 2 cm deep. Each box was constructed of Perspex (trade mark) sheet material and defined a chamber which was filled with a doped oil having a resistivity of 1.25 Mohm.m The angle subtended by each of the upper electrode plates 4 at the upper surface 7 of the lower electrode plate 1 was 10°, measured in a vertical plane perpendicular to the forward direction. The central block 3 was about 4 cm wide.

The electrode separation was 20 mm, this being the vertical distance between the upper surface 7 of the lower electrode means 1 and the lowermost side of the central member 3 of the upper electrode means.

Four sets of experiments were carried out. Three sets were carried out using a standardised carbon-contaminated PFA containing 22%±0.5% carbon; for the remaining set a carbon-contaminated PFA was used containing 30.5%±0.5% carbon.

Each set of experiments comprised three stages. Before each stage, the apparatus was vacuum cleaned in order to remove any ash adhering to the electrodes. The generator providing the AC field comprised means for selectively varying the frequency of the field from 10 to 200 Hz: the required frequency was selected before each stage. The pulsed air system (arranged to deliver jets of air through the slot 17 and the series of holes in the central member 3) was not utilised in these experiments.

The resistance in each oil-filled electrode was 54 Mohm and the resistance to ground (24 in FIG. 4) was 20 Mohm. The power supply was switched on at the start of each experiment, establishing a voltage at the inner edge of each oil-filled electrode of 19 kV and a voltage at the outer edge of each oil-filled electrode of 8.36 kV. The applied voltage recorded in each case was taken as the root mean square value measured at the upper electrode means.

The power supply to the electrode means having been switched on, a sample of approximately 300 g of contaminated PFA was placed in the hopper 8 and the associated vibratory feeder 11 was then switched on, as was the vibratory transducer 12 on which the lower electrode was mounted. The particulate material was then passed through the apparatus and the individual fractions collected in the receptacles provided. This constituted stage 1 of the experiment. Fractions from receptacles D, E and F were collected, mixed, labelled, weighed and stored for subsequent analysis. The symmetrically collected fractions (i.e. the fractions collected in the receptacles marked with the same reference letter in FIG. 1) were mixed in order to reduce the analyses required.

The fractions from receptacles A, B and C were mixed together, the resultant mixture being placed in the hopper as the feed for stage 2. Stage 2 was then conducted analogously to stage 1, except that the feed rate was reduced by a proportion approximately equal to the proportion of the total mass of the feed for stage 1 that was collected in receptacles D, E and F during stage 1.

The fractions collected in receptacles D, E and F during stage 2 were mixed, labelled, weighed and stored as in stage 1. The fractions from receptacles A, B and C were mixed together to provide the feed for stage 3. Stage 3 was conducted analogously to the previous stages, with a corresponding reduction in feed rate. At the end of stage 3, the fraction received in each receptacle was collected, labelled, weighed and stored for subsequent analysis.

The feed rate was calculated from the time required for the vibratory feeder 11 to feed a given mass of contaminated PFA from the hopper 8 into the electrostatic separator.

A conveyor speed of 11 cm/s was employed in each experiment, this being the velocity of the PFA travelling over the lower electrode plate. To measure this, a batch of approximately 10 g of PFA was placed at the rear end of the lower electrode plate and the time required to discharge the batch at the other end of the electrode plate was recorded. No field was applied during the measurement of the conveyor speed (calculated by dividing the length of the lower electrode plate by the recorded time).

The carbon content of a fraction was measured according to the ASTM Standard No. D3174-73. About 1 g of the fraction was dried for two hours in a vacuum oven at 105° C. and the sample was then burned for three hours at 750° C. in a porcelain crucible of 35 $cm^3$ volume. The resultant loss of weight in grams was then measured.

After the three stages had been completed and the fractions analysed, fractions were variously combined into samples. The criteria for selection of the fractions for combination into each sample were that two samples should be obtained containing less than 7% carbon and more than 38% carbon respectively and that if a third sample of an intermediate carbon content is obtained, the size of that sample should be minimised.

The combinations for each set were as follows (suffixes 1, 2 and 3 refer to the stage from which the fraction was collected):

TABLE 1

| Sample No. | Made up of Fractions from receptacles |
|---|---|
| Set 1 | |
| 1 | $A_3 + B_3 + C_3$ |
| 2 | $D_1 + E_1 + F_1 + D_2 + E_2 + F_2 + E_3 + F_3$ |
| 3 | $D_3$ |
| Set 2 | |
| 1 | $A_3 + B_3 + C_3$ |
| 2 | $D_1 + E_1 + F_1 + D_2 + E_2 + F_2$ |
| 3 | $D_3 + E_3 + F_3$ |
| Set 3 | |
| 1 | $A_3 + B_3 + C_3$ |
| 2 | $D_1 + E_1 + F_1 + D_2 + E_2 + F_2 + D_3 + E_3 + F_3$ |
| Set 4 | |
| 1 | $A_3$ |
| 2 | $C_3 + B_3 + D_3 + E_3 + F_3 + D_1 + E_1 + F_1 + D_2 + E_2 + F_2$ |

For each set, the following experimental data are shown below in Table 2, namely: the carbon content of the original feed batch used for the set; the electrical frequency for each stage; and the relative mass and carbon content for each sample obtained by the fraction combination as described above.

TABLE 2

| Stage No. | Frequency (Hz) | Feed Rate (g/min) | Sample No. | Relative Mass of Feed (%) | Carbon Content (%) |
|---|---|---|---|---|---|
| | | Experimental Results | | | |
| | Set No. 1 - Original feed containing 22.3% carbon | | | | |
| 1 | 60 | 381 | 1 | 47.5 | 6.8 |
| 2 | 60 | 346 | 2 | 44.2 | 39.8 |
| 3 | 25 | 252 | 3 | 8.4 | 17.6 |
| | Set No. 2 - Original feed containing 21.8% carbon | | | | |
| 1 | 60 | 387 | 1 | 39.5 | 7.3 |
| 2 | 25 | 291 | 2 | 39.8 | 38.7 |
| 3 | 25 | 198 | 3 | 20.7 | 17.0 |
| | Set No. 3 - Original feed containing 21.6% carbon | | | | |
| 1 | 60 | 396 | 1 | 54.4 | 7.0 |
| 2 | 60 | 305 | 2 | 45.9 | 38.5 |
| 3 | 25 | 224 | | | |
| | Set No. 4 - Original feed containing 30.9% carbon | | | | |
| 1 | 60 | 412 | 1 | 49.3 | 15.0 |
| 2 | 25 | 391 | 2 | 50.7 | 46.4 |
| 3 | 25 | 312 | | | |

From the above results, it can be seen that the frequency of the electric field can significantly affect the degree of separation obtainable and can be used to optimise the process with a view to obtaining material of either a high or a low carbon content.

We claim:

1. A method of separating particles having different physical properties, which comprises generating an alternating electric field, the electric field having a first region having field lines curved convexly in a first direction generally perpendicular to a given direction; introducing the particles into the field; charging at least some of the particles; and causing the particles to move along the field in the said given direction, whereby a charged particle acted upon by the electric field in the said first region is subjected to a centrifugal force in the said first direction, characterised in that the electrical potential across the said first region of the field varies with distance along the said first direction.

2. A method according to claim 1, characterised in that the electric field has a second region having field lines curved convexly in a second direction generally perpendicular to said given direction, whereby a charged particle acted upon by the electric field in the said second region is subjected to a centrifugal force in the said second direction, and wherein the electrical potential across said second region varies with distance along said second direction.

3. A method according to claim 2, characterised in that the particles are introduced into the electric field at a point between the said first and second regions of that field.

4. A method according to claim 2 or 3, characterised in that the said first and second directions are generally opposite to each other transversely of the said given direction.

5. A method according to claim 1 or 2, characterised in that the potential across each said region varies in a stepwise manner.

6. A method according to claim 1 or 2, characterised in that the potential across each said region varies in a continuous manner.

7. A method according to claim 1 or 2, characterised in that the potential across each said region decreases with distance along the respective perpendicular direction.

8. A method according to claim 1 or 2, characterised in that charging of the particles is effected by triboelectrification and/or by conductive induction.

9. A method according to claim 1 or 2, characterised in that the particles are driven along the field by mechanical vibration.

10. A method according to claim 1 or 2, characterised in that the particles are fluidised within the electric field to permit them to move along the field under the force of gravity.

11. An apparatus for separating particles having different properties, which comprises means for generating an alternating electric field, the electric field having a first region having field lines curved convexly in a first direction generally perpendicular to a given direction; means for introducing the particles into the field; means for charging at least some of the particles; and means for causing the particles to move along the field in the said given direction; characterised in that the means for generating the electric field is such that the electrical potential across the said first region of the field varies with distance along the said first direction.

12. An apparatus according to claim 11, characterised in that the field-generating means is such that the electric field has a second region having field lines curved convexly in a second direction generally perpendicular to said given direction, wherein the electrical potential across said second region varies with distance along said second direction.

13. An apparatus according to claim 11, characterised in that the field-generating means comprises a first electrode means; the particle-charging means is a first surface provided by the first electrode means, which first surface is electrically conductive; the particle-introducing means is arranged to deliver the particles unto the said first surface of the first electrode means; the particle-moving means is adapted to move the particles along the said first surface in a given direction; the field-generating means also comprises a second electrode means providing at least one surface defining a respective region of the field, and power source means adapted to apply an alternating electrical potential difference between the first and the second electrode means and produce an alternating electric field extending between the said first surface and each said surface of the second electrode means; each said surface of the second electrode means diverges from the first surface in a direction generally perpendicular to the said given direction; and the arrangement is such that the electrical potential across each said surface of the second electrode means varies with distance along a direction perpendicular to the given direction.

14. An apparatus according to claim 13, characterised in that the second electrode means provides two surfaces, one of which diverges from the said first surface to one side of the apparatus and the other of which diverges from the said first surface to the other side of the apparatus.

15. An apparatus according to claim 13 or 14, characterised in that the particle-moving means is a vibratory feeder on which the first electrode means is mounted.

16. An apparatus according to claim 13 or 14, characterised in that the said first surface of the first electrode means slopes downwards in the said given direction and is defined by a gas-permeable plate, means being provided for passing gas upwards through the gas-permeable plate at a rate to fluidise particles on the said first surface so that they move in the given direction under the force of gravity.

17. An apparatus according to claim 13, characterised in that the second electrode means provides two said surfaces, each of which is defined by a member, said members being arranged as wings extending from either side of an elongate member formed of a dielectric material.

18. An apparatus according to claim 17, characterised in that the two said surfaces of the second electrode means are disposed at an angle equal to or more than $\pi$ radians to each other.

19. An apparatus according to claim 13, characterised in that each said surface of the second electrode means is defined by a member comprising a body of conductive material, said member being connected to the power source means such that the edge of the member closest to the first surface is at a higher voltage than is the edge furthest from said first surface.

20. An apparatus according to claim 19, characterised in that the conductive material is oil doped with one or more metal salts.

21. An apparatus according to claim 13, characterised in that each said surface of the second electrode means is defined by a member comprising a series of at least two conductive plates, each plate being separated from the next plate in the series by dielectric material, the member being connected to power source means such that a different potential is applied to each plate.

22. An apparatus according to claim 21, characterised in that the power source means comprises a respective power source for each plate.

* * * * *